US005546860A

United States Patent [19]

Riis

[11] Patent Number: 5,546,860

[45] Date of Patent: Aug. 20, 1996

[54] DEVICE FOR ADJUSTING DISTANCES BETWEEN AXES OF CYLINDERS IN A PRINTING MACHINE

[75] Inventor: Einar K. Riis, Skodsborg, Denmark

[73] Assignee: Werner Kammann Maschinenfabrik GmbH, Bünde, Germany

[21] Appl. No.: 495,458

[22] Filed: Jul. 28, 1995

[30] Foreign Application Priority Data

Feb. 3, 1993 [DK] Denmark ..... 0125/93

[51] Int. Cl.[6] ..... B41F 13/24

[52] U.S. Cl. ..... 101/247; 101/177; 101/218

[58] Field of Search ..... 101/247, 248, 101/218, 351, 352, 177, 182, 180

[56] References Cited

U.S. PATENT DOCUMENTS

| | | | |
|---|---|---|---|
| 4,458,591 | 7/1984 | Guaraldi | 101/247 |
| 4,833,982 | 5/1989 | Liebert et al. | 101/177 |
| 5,081,927 | 1/1992 | Jahn | 101/218 |
| 5,228,390 | 7/1993 | Jahn | 101/352 |
| 5,311,817 | 5/1994 | Funada | 101/177 |

FOREIGN PATENT DOCUMENTS

| | | |
|---|---|---|
| 0242661A2 | 10/1987 | European Pat. Off. . |
| 2234707 | 2/1991 | United Kingdom . |

*Primary Examiner*—Eugene H. Eickholt
*Attorney, Agent, or Firm*—Pennie & Edmonds

[57] ABSTRACT

In a printing machine (frame etc. not shown) a counterpressure cylinder (1) is rotatably supported in cylindrical bearing housings (5) bordering on the counterpressure cylinder (1) and being held rotatably in the printing machine by means of rollers (10, 11, 12, 13). Opposite to each of these bearing housings (5) is a bearing housing (8) for a plate cylinder (2), the later bearing housing (8)bordering on the plate cylinder (2) and likewise being held in the printing machine between pollers (14, 15, 16, 17). One of these rollers (14) is rotatably supported in the bearing housing (5) for the counterpressure cylinder (1), while two of the rollers (16, 17)act on the bearing housings (8) for the plane cylinder (2) with a classically yielding pressing force. By means of an actuating mechanism (21, 22, 23, 24) each of the bearing housing (5) for the counterpressure cylinder (1) can be turned from a position in which the axis of the roller (1-4) in the bearing housings (5) is coplanar with the axes of the counterpressure cylinder (1) and the plate cylinder (2), to a non-co-planar position, thus reducing the distance between the axes of the cylinders (1, 2).

8 Claims, 2 Drawing Sheets

DEVICE FOR ADJUSTING DISTANCES BETWEEN AXES OF CYLINDERS IN A PRINTING MACHINE

TECHNICAL FIELD

The present invention relates to a device for adjusting the distance betweeen the axis of a counterpressure cylinder and a plate cylinder, possibly also between the axis of the plate cylinder and an inking cylinder, in a printing machine.

DISCLOSURE OF THE INVENTION

It is the object of the present invention to provide a device of the kind referred to above, with which it is possible I. during the operation of the printing machine to adjust the distance between the axes of a counterpressure cylinder and a plate cylinder, and possibly so that this distance is shorter at one end of the cylinders than at the other end in order to achieve a uniform deposition of ink across the width of the printed web, when the printing area of the plate cylinder is larger at one end than at the other, and II. when the printing machine is inoperative, to set such a distance between the axis of the counterpressure cylinder and the plate cylinder, possibly also between the axis of the latter and the inking cylinder, that the cylinders do not press against or abut against each other, as such a pressure against the plate cylinder entails a risk of deformation of the printing plate on the plate cylinder, thus causing later prints to be slurred or subject to other deterioration.

The stated object is achieved by means of the features set forth in the claims.

With such a device, it is possible during the operation of the printing machine to adjust individually the distance between the axes of a counterpressure cylinder and a plate cylinder at each end of the cylinders, and also in the inoperative condition of the printing machine to set the distances between the axes of the counterpressure cylinder and the plate cylinder, possibly also between the axes of the latter and the inking cylinder, in such a manner, that these cylinders do not press against each other.

BRIEF DESCRIPTION OF THE DRAWING

In the following detailed portion of the present description, the invention will be explained in more detail with reference to the relevant parts of a printing machine shown in the drawing, in which FIG. 1 diagrammatically and in perspective shows a part of a printing machine comprising a counterpressure cylinder, a plate cylinder and an inking cylinder as well as devices according to the present invention.

DESCRIPTION OF THE PREFERRED EMBODIMENT

Figure 1:
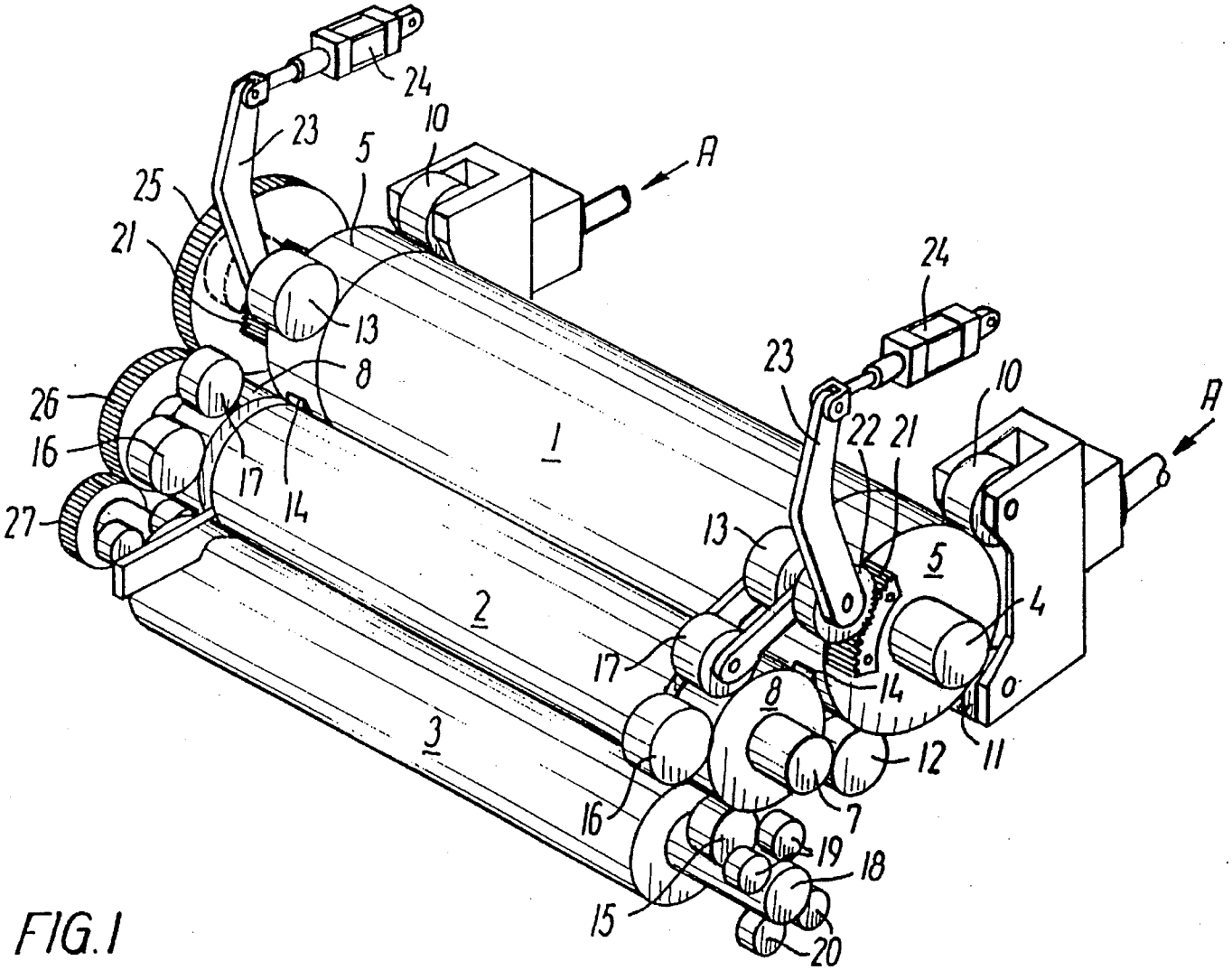

For ease of understanding, the drawing shows solely those constructional elements in the printing machine being of immediate importance with a view to explaining the present invention, while constructional details, such as the frame of the printing machine and the means for securing and supporting of the elements shown in this frame, have not been included, such details being obvious or near-at-hand to a person skilled in this particular art.

FIG. 1 shows a counterpressure cylinder 1, a plate cylinder 2 and an inking cylinder 3.

The stub shafts 4 of the counterpressure cylinder 1, of which only one is shown, are rotatably supported in bearing housings 5 bordering on the counterpressure cylinder 1 and being substantially cylindrical and having the same diameter as the counterpressure cylinder 1. Each of the bearing housings 5 is rotatably secured in the frame of the machine (not shown) by means of four rollers 10, 11, 12 and 13. As indicated with arrows A, the rollers 10 and 11 may be adjustable relative to the frame of the printing machine.

Figure 2:
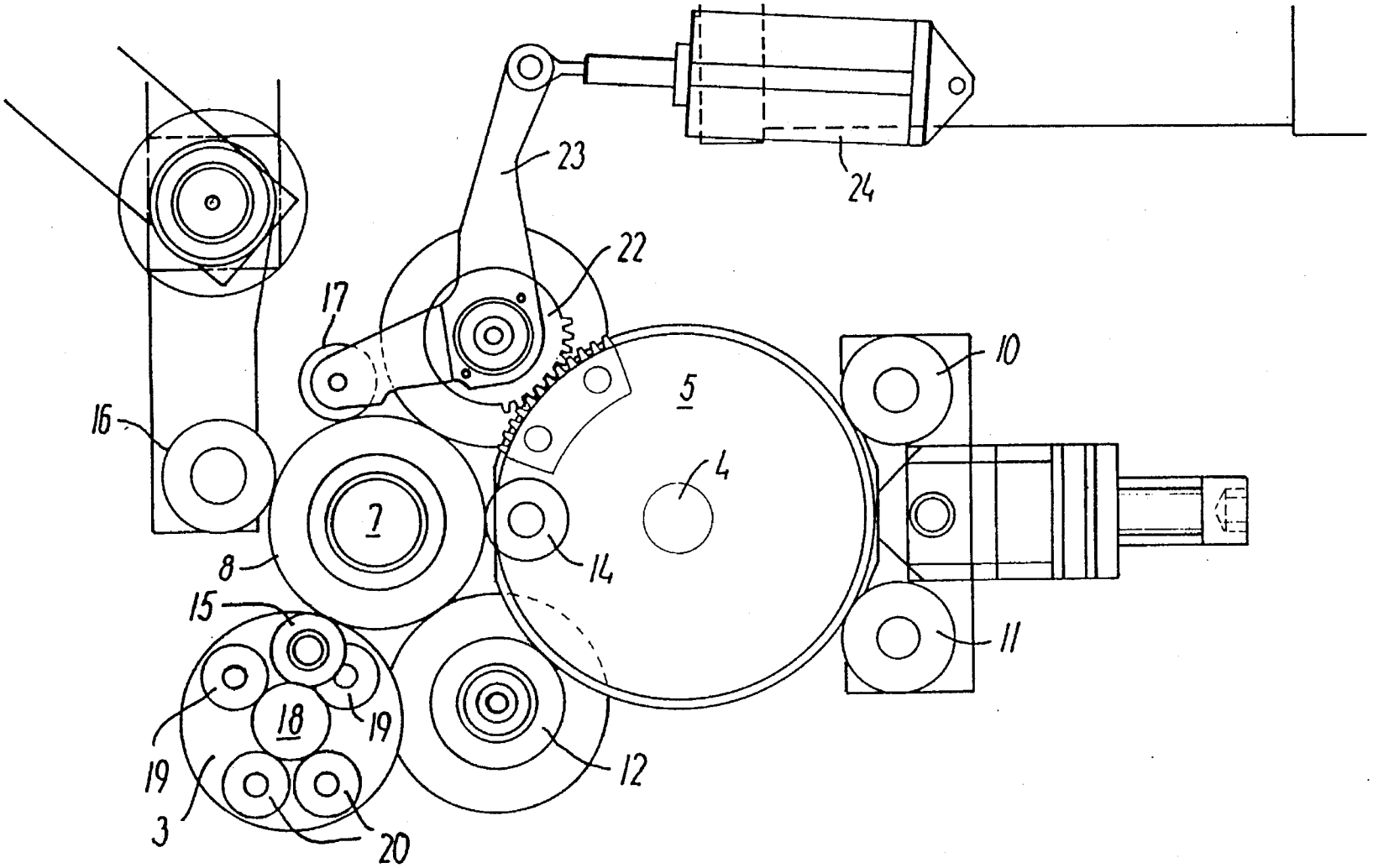
FIG. 2 shows the part of the printing machine shown in FIG. 1, as viewed from the side.

In a similar manner, the bearing stub shafts 7 of the plate cylinder 2, of which likewise only one is shown in the drawing, are rotatably supported in bearing housings 8 bordering on the plate cylinder 2. Each of the bearing housings 8, being shown on the drawing as being cylindrical with the same diameter as the plate cylinder 2, although it does not necessarily have to be so, is secured in a non-rotatable manner, e.g. guided by a key in a keyway (not shown) in the bearing housing 8, and held securely in the frame of the printing machine by means of four rollers 14, 15, 16 and 17 (FIG. 2). Of these, the roller 14 is rotatably supported in the adjacent bearing housing 5 for the counterpressure cylinder 1 with its rotational axis parallel to the axis of the counterpressure cylinder 1 and in such a manner, that part of the cylindrical surface of the roller 14 protrudes somewhat beyond the cylindrical surface of the bearing housing 5. The rollers 16 and 17 are in abutment against the mainly cylindrical surface of the bearing housing 8 with an elastically yielding force, and the roller 15 is, in a manner to be explained below, associated with the stub-shaft bearing arrangement for the inking cylinder 3.

Each of the bearing housings 5 for the counterpressure cylinder 1 is provided with a toothed sector 21 in engagement with another toothed sector 22 on a lever 23, the pivoting axis of which is fixed relative to the frame of the printing machine, and the lever 23 is linked to an actuating mechanism in the form of a piston-cylinder unit 24 being fixedly secured to the frame (not shown) of the printing machine.

The manner of functioning of the device for adjusting the distance between the axis of the counterpressure cylinder 1 and the plate cylinder 2 will now be described with reference to the adjusting mechanism shown to the right in FIG. 1 and in FIG. 2, the two mechanisms being identical in construction and function.

When fluid under pressure is controlled to flow towards or away from the piston-cylinder unit 24, the piston rod in this unit moves inwardly, thus moving the lever 23 towards the right in FIGS. 1 and 2. This causes the toothed sector 22 to turn clockwise and hence the toothed sector 21 and with it the bearing housing 5 anticlockwise. This again causes the roller 14 to swing away from its position shown in FIG. 2, in which its axis is co-planar with the axes of the counterpressure cylinder 1 and the plate cylinder 2, to a lower position. Since the roller 14 abuts against the bearing housing 8 of the plate cylinder 2, its change in position causes the bearing housing 8, influenced by the elastically yielding force from the rollers 16 and 17, to move towards the bearing housing 5 for the counterpressure cylinder 1, i.e. the axes of the plate cylinder 2 is made to approach the axes of the counterpressure cylinder 1.

This turning of the bearing housing 5 and the ensuing swinging movement of the roller 14 may be continued, although it is necessary for the roller 14 to be continously in abutment against the bearing housing 8 in order to support this effect.

Normally, the flow of pressure fluid to and from the two piston-cylinder units 24 will be controlled in unison, so that the axes of the counterpressure cylinder 1 and the plate cylinder 2 remain parallel. In case the printing area of the plate cylinder 2, i.e. the pattern or image to be printed, is larger at one end than at the other, measures may be taken for individually controlling the flow of pressure fluid to and from each of the two piston-cylinder units 24 in such a manner, that the axes of the counterpressure cylinder 1 and the plate cylinder 2 are not parallel.

When the printing machine is inoperative, the arrangement is such, that the piston-cylinder unit 24 automatically moves the bearing housing 5 to the position shown in FIG. 2, in which the axis for the rollers 14 is co-planar with the axes of the counterpressure cylinder 1 and the plate cylinder 2, thus setting the distance between these axes to a maximum. This distance should, of course, not be greater than to ensure that the driving pinions 25 and 26 for the counterpressure cylinder 1 and the plate cylinder 2 respectively always remain safely in mesh.

It does, of course, lie within the scope of the invention to replace the operating mechanism 21, 22, 23 and 24 for turning each of the bearing housings 5 with an equivalent operating mechanism, e.g. a screw-spindle drive.

Each of the stub shafts 18 of the inking cylinder 3, of which only one is shown in the drawing, is rotatably supported between two pairs of mutually facing rollers 19 and 20, the rotational axes of which are parallel to the axis of the inking cylinder 3. The shafts for the rollers 19 are rigidly connected, e.g. by means of a plate member (not shown), with the shaft for the roller 15 in such a manner, that the cylindrical surface of the latter protrudes somewhat beyond the cylindrical surface of the inking cylinder 3.

Further, these shafts and hence the rollers 19 and the roller 15 are supported for limited swinging movement about the axis of the inking cylinder 3 by means of an operating mechanism (not shown), e.g. a mechanism of the same kind as or similar to the operating mechanism 21, 22, 23 and 24 described above with reference to the device for adjusting the distance between the axes of the counterpressure cylinder 1 and the printing cylinder 2.

By swinging the roller 15 about the axis of the inking cylinder 3, the roller 15 can be moved from a position, in which its axis is co-planar with the axes of the plate cylinder 2 and the inking cylinder 3, to a position outside of the plane through these axes, and in this manner it is possible to adjust the distance between the axes of the plate cylinder 2 and the inking cylinder 3 in a similar way as explained above with reference to the axes of the counterpressure cylinder 1 and the plate cylinder 2.

Primarily, however, the operating mechanism (not shown) for swinging the rollers 19 and the roller 15 is adapted, when the printing machine is inoperative, to automatically adjust the roller 15 for each end of the inking cylinder 3, to a position co-planar with the axes of the plate cylinder and the inking cylinder and hence adjust the distance between these two axes to a maximum, not greater than always to secure a safe mesh between the driving pinions 26 and 27 for the plate cylinder 2 and the inking cylinder 3 respectively.

Also with this device for adjusting the distance between the axes of the plate cylinder 2 and the inking cylinder 3, the two operating mechanisms for the two ends of the inking cylinder 3 may, of course, be adapted to function both in unison and individually, so that in the latter case, the axes may also be adjusted to a non-parallel relation.

Even though the devices according the present invention have been described above with reference to a printing machine for flexography, it will easily be appreciated that similar, modified devices based on the principles of the present invention may be used in connection with other forms of printing, such as letterpress printing, offset printing, photogravure or rotogravure and silk-screen printing.

LIST OF PARTS

A Arrow
1 Counterpressure cylinder
2 Plate cylinder
3 Inking cylinder
4 Stub shaft
5 Bearing housing
7 (Bearing) stub shaft
8 Bearing housing
10 Roller
11 Roller
12 Roller
13 Roller
14 Roller
15 Roller
16 Roller
17 Roller
18 Stub shaft
19 Roller
20 Roller
21 Toothed sector
22 Toothed sector
23 Lever
24 Piston-cylinder unit
25 Driving pinion
26 Driving pinion
27 Driving pinion

I claim:

1. Device for adjusting the distance between the axes of a counterpressure cylinder (1) and a plate cylinder (2), and optionally also between the axes of the plate cylinder (2) and an inking cylinder (3) in a printing machine, wherein:

a) the counterpressure cylinder (1) has an axis of rotation and includes stub shafts (4) at opposite ends thereof extending along said axis, said stub shafts (4) being rotatably supported in first bearing housings (5) of generally cylindrical shape and bordering on the opposite ends of the counterpressure cylinder (1);

b) each bearing housing (5) is rotatably held between rollers (10, 11, 12, 13) in the printing machine and comprises a projection in the form of a roller (14) which includes a cylindrical surface that is rotatably supported in the bearing housing (5) about an axis parallel to said axis of the counterpressure cylinder (1), said cylindrical surface protruding beyond the cylindrical surface of the bearing housing (5);

c) the plate cylinder (2) has an axis of rotation and includes stub shafts (7) at opposite ends thereof extending along the last mentioned axis, said last mentioned stub shafts (7) being rotatably supported in second bearing housings (8) of generally cylindrical shape and bordering on the opposite ends of the plate cylinder (2), each of said second bearing housings (8) being yieldingly held between the roller (14) in the adjacent first bearing housing (5) for the counterpressure cylinder (1) and rollers (15, 16, 17) in the printing machine, and d) a mechanism (21, 22, 23, 24) is provided for turning each first bearing housing for the counterpressure cylinder (1) from a position in which the axis of said roller (14) is co-planar with the axes of rotation of counterpressure cylinder (1) and the plate cylinder (2), and in which the distance between the two last-mentioned axes is at maximum, to a position in which the axis of the roller (14) is not co-planar with the axes of rotation of the counterpressure cylinder (1) and the plate cylinder (2); and, e) the inking cylinder (3) has an axis of rotation and includes stub shafts (18) at opposite ends thereof extending along the last mentioned axis, said last mentioned stub shafts (18) being yieldingly held between mutually opposing pairs (19, 20) of rollers, the rollers of each pair having shafts at opposite ends thereof, with the shafts for one (19) of the pairs being rigidly connected to a shaft for one (15) of said rollers (15, 16, 17) holding the second bearing housing (8) for the plate cylinder (2) and being situated closest to the inking cylinder (3), said rigidly interconnected shafts being capable of swinging to a limited extent about the axis of rotation of the inking cylinder (3) in such a manner, that said one roller (15), with its own axis of rotation and a cylindrical surface which protrudes beyond the cylindrical surface of the inking cylinder, may be made to swing from a position in which its own axis is co-planar with the axes of the plate cylinder (2) and the inking cylinder (3) and the distance between the two last-mentioned axes is at a maximum, to a position in which said axis of said roller (15) is not co-planar with said axes of said plate cylinder (2) and said inking cylinder (3).

2. Device according to claim 1, wherein:

a) said first bearing housings (5) for the counterpressure cylinder (1) have substantially the same diameter as said counterpressure cylinder, and b) the second bearing housings (8) for the plate cylinder (2) have substantially the same diameter as said plate cylinder.

3. Device according to claim 1 or claim 2, wherein said mechanism for turning each of the first bearing housings (5) of the counterpressure cylinder (1) comprises a toothed sector (21 ) on each first bearing housing (5) engaging a toothed sector (22) on a lever (23) pivotably supported in the printing machine, each said lever (23) being linked to the piston rod in one of a pair of piston-cylinder units (24) actuated by fluid under pressure.

4. Device according to claim 3, wherein said piston-cylinder units (24) are adapted to be controlled both in unison and individually.

5. Device according to claim 4, wherein when the printing machine is inoperative, each of the rollers (14) are in a position, in which its axis is co-planar with the axes of the counterpressure cylinder (1) and the plate cylinder (2), and in which the distance between the two last-mentioned axes is at a maximum.

6. Device according to claim 5, wherein in said position of each of the rollers (14), the driving pinions (25, 26) for the counterpressure cylinder (1) and the plate cylinder (2) respectively are in secure interengagement.

7. Device according to claim 1, wherein when the printing machine is inoperative, each of the rollers (15) holding the second bearing housings (8) for the plate cylinder (2) is in a position in which its axis is co-planar with the axes of the plate cylinder (2) and the inking cylinder (3), and in which the distance between the two last-mentioned axes is at a maximum.

8. Device according to claim 7, wherein said position of the rollers (15), the driving pinions (26, 27) for the plate cylinder (2) and the inking cylinder (3) respectively are in secure interengagement.

* * * * *